US006910007B2

(12) United States Patent
Stylianou et al.

(10) Patent No.: US 6,910,007 B2
(45) Date of Patent: Jun. 21, 2005

(54) STOCHASTIC MODELING OF SPECTRAL ADJUSTMENT FOR HIGH QUALITY PITCH MODIFICATION

(75) Inventors: Ioannis G (Yannis) Stylianou, Madison, NJ (US); Alexander Kain, Portland, OR (US)

(73) Assignee: AT&T Corp, New York, NY (US)

( * ) Notice: Subject to any disclaimer, the term of this patent is extended or adjusted under 35 U.S.C. 154(b) by 615 days.

(21) Appl. No.: 09/769,112

(22) Filed: Jan. 25, 2001

(65) Prior Publication Data

US 2003/0208355 A1 Nov. 6, 2003

Related U.S. Application Data

(60) Provisional application No. 60/208,374, filed on May 31, 2000.

(51) Int. Cl.[7] ..... G10L 11/04

(52) U.S. Cl. ..... 704/207; 704/260; 704/219; 704/267

(58) Field of Search ..... 704/260, 219, 704/267, 207

(56) References Cited

U.S. PATENT DOCUMENTS 5,473,728 A * 12/1995 Luginbuhl et al. ..... 704/243
5,675,702 A * 10/1997 Gerson et al. ..... 704/223
5,970,453 A * 10/1999 Sharman ..... 704/260
6,453,287 B1 * 9/2002 Unno et al. ..... 704/219
6,470,312 B1 * 10/2002 Suzuki et al. ..... 704/219

* cited by examiner

*Primary Examiner*—David L. Ometz
*Assistant Examiner*—Jakieda R Jackson
(74) *Attorney, Agent, or Firm*—Henry T. Brendzel

(57) ABSTRACT

Natural-sounding synthesized speech is obtained from pieced elemental speech units that have their super-class identities known (e.g. phoneme type), and their line spectral frequencies (LSF) set in accordance with a correlation between the desired fundamental frequency and the LSF vectors that are known for different classes in the super-class. The correlation between a fundamental frequency in a class and the corresponding LSF is obtained by, for example, analyzing the database of recorded speech of a person and, more particularly, by analyzing frames of the speech signal.

18 Claims, 1 Drawing Sheet

STOCHASTIC MODELING OF SPECTRAL ADJUSTMENT FOR HIGH QUALITY PITCH MODIFICATION

Figure 1:
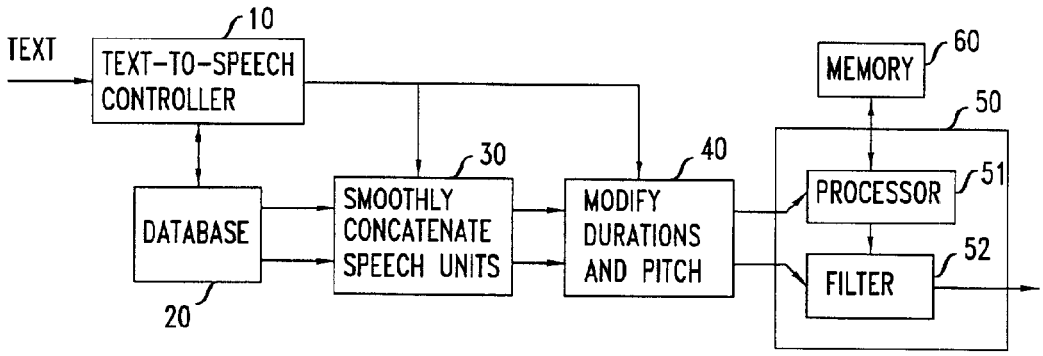

This application claims priority under application Ser. No. 60/208,374 filed on May 31, 2000.

BACKGROUND OF THE INVENTION

This invention relates to speech and, more particularly, to a technique that enables the modification of a speech signal so as to enhance the naturalness of speech sounds generated from the signal.

Concatenative text-to-speech synthesizers, for example, generate speech by piecing together small units of speech from a recorded-speech database and processing the pieced units to smooth the concatenation boundaries and to match the desired prosodic targets (e.g. speaking speed and pitch contour) accurately. These speech units may be phonemes, half phones, di-phones, etc. One of the more important processing steps that are taken by prior art systems, in order to enhance naturalness of the speech, is modification of pitch (i.e., the fundamental frequency, $F_0$) of the concatenated units, where pitch modification is defined as the altering of $F_0$. Typically, the prior art systems do no not modify the magnitude spectrum of the signal. However, it has been observed that large modification factors for $F_0$ lead to a perceptible decrease in speech quality, and it has been shown that at least one of the reasons for this degradation is the assumption by these prior art system that the magnitude spectrum can remain unaltered. In particular, T. Hirahara has shown in "On the Role of Fundamental Frequency in Vowel Perception," *The Second Joint Meeting of ASA and ASJ*, November 1988, that an increase of $F_0$ was observed to cause a vowel boundary shift or a vowel height change. Also, in "Vowel F1 as a Function of Speaker Fundamental Frequency," 110$^{th}$ *Meeting of JASA*, vol. 78, Fall 1985, A. K. Syrdal and S. A. Steele showed that speakers generally increase the first formant as they increase $F_0$. These results clearly suggest that the magnitude spectrum must be altered during pitch modification. Recognizing this need, K. Tanaka and M. Abe suggested, in "A New fundamental frequency modification algorithm with transformation of spectrum envelope according to $F_0$," *ICASSP* vol. 2, pp. 951–954, 1997, that the spectrum should be modified by a strectched difference vector of a codebook mapping. A shortcoming of this method is that only three ranges of $F_0$ (high, middle, and low) are encoded. A smoother evolution of the magnitude spectrum (of an actual speech signal), or the spectrum envelope (of a synthesized speech signal), as a function of changing $F_0$ is desirable.

SUMMARY

An advance in the art is achieved with an approach that develops synthesized speech is obtained from pieced elemental speech units that have their super-class identities known (e.g. phoneme type), and their line spectral frequencies (LSF) set in accordance with a correlation between the desired fundamental frequency and the LSF vectors that are known for different classes in the super-class. The correlation between a fundamental frequency in a class and the corresponding LSF is obtained by, for example, analyzing the database of recorded speech of a person and, more particularly, by analyzing frames of the speech signal. In one illustrative embodiment, a text-to-speech synthesis system concatenates frame groupings that belong to specified phonemes, the phonemes are conventionally modified for smooth transitions, the concatenated frames have their prosodic attributes modified to make the synthesized text sound natural—including the fundamental frequency. The spectrum envelop of modified signal is then altered based on the correlation between the modified fundamental frequency in each frame and LSFs.

DETAILED DESCRIPTION

FIG. 1 presents one illustrative embodiment of a system that benefits from the principles disclosed herein. It is a voice synthesis system; for example, a text-to-speech synthesis system. It includes a controller 10 that accepts text and identifies the sounds (i.e., the speech units) that need to be produced, as well as the prosodic attributes of the sounds; such as pitch, duration and energy of the sounds. The construction of controller 10 is well known to persons skilled in the text-to-speech synthesis art.

To proceed with the synthesis, controller 10 accesses database 20 that contains the speech units, retrieves the necessary speech units, and applies them to concatenation element 30, which is a conventional speech synthesis element. Element 30 concatenates the received speech units, making sure that the concatenations are smooth, and applies the result to element 40. Element 40, which is also a conventional speech synthesis element, operates on the applied concatenated speech signal to modify the pitch, duration and energy of the speech elements in the concatenated speech signal, resulting in a signal with modified prosodic values.

It is at this point that the principles disclosed herein come into play, where the focus is on the fact that the pitch is modified. Specifically, the output of element 40 is applied to element 50 that, with the aid of information stored in memory 60, modifies the magnitude spectrum of the speech signal.

As indicated above, database 20 contains speech units that are used in the synthesis process. It is useful, however, for database 20 to also contain annotative information that characterizes those speech units, and that information is retrieved concurrently with the associated speech units and applied to elements 30 et seq. as described below. To that end, information about the speech of a selected speaker is recorded during a pre-synthesis process, is subdivided into small speech segments, for example phonemes (which may be on the order of 150 msec), is analyzed, and stored in a relational database table. Illustratively, the table might contain the fields:

Record ID,
phoneme label,
average $F_0$,
duration.

To obtain characteristics of the speaker with finer granularity, it is useful to also subdivide the information into frames, for example, 10 msec long, and to store frame information together with frame-annotation information. For example, a second table of database 20 may contain the fields:

Record ID,
parent Phoneme record ID,
$F_0$,
speech samples of the frame.
line spectral frequencies (LSF) vector of the speech samples,
linear prediction coefficients (LPC) vector of the speech samples.

It may be noted that the practitioner has fair latitude as to what specific annotative information is developed for storage in database 20, and the above fields are merely illustrative. For example the LPC can be computed "on the fly" from the LSFs, but when storage is plentiful, one might wish to store the LPC vectors.

Once the speech information of the recorded speaker is analyzed and stored in database 20, in the course of a synthesis process controller 10 can specify to database 20 a particular phoneme type with a particular average pitch and duration, identify a record ID that most closely fulfills the search specification, and then access the second database to obtain the speech samples of all of the frames that correspond to the identified record ID, in the correct sequence. That is, database 20 outputs to element 30 a sequence of speech sample segments. Each segment corresponds to a selected phoneme, and it comprises plurality of frames or, more particularly, it contains the speech samples of the frames that make up the phoneme. It is expected that, as a general proposition, the database will have the desired phoneme type but will not have the precise average $F_0$ and/or duration that is requested. Element 30 concatenates the phonemes under direction of controller 10 and outputs a train of speech samples that represent the combination of the phonemes retrieved from database 20, smoothly combined. This train of speech samples is applied to element 40, where the prosodic values are modified, and in particular where $F_0$ is modified. The modified signal is applied to element 50, which modifies the magnitude spectrum of the speech signal in accord with the principles disclosed herein.

As indicated above, research suggests that the spectral envelope modifications that element 40 needs to perform are related to the changes that are effected in $F_0$; hence, one should expect to find a correlation between the spectral envelope and $F_0$. To learn about this correlation, one can investigate different parameters that are related to the spectral envelope, such as the linear predictive codes (LPCs), or the line spectral frequencies (LSFs). We chose to use bark-scale warped LSFs because of their good interpolation and coding properties, as demonstrated by K. K. Paliwal, in "Interpolation Properties of Linear Prediction Parametric Representations," Proceedings of EUROSPEECH, pp. 1029–32, September 1995. Additionally, the bark-scale warping effects a frequency weighting that is in agreement with human perception.

In consonance with the decision to use LSFs in seeking a method for estimating the necessary evolution of a spectral envelope with changes to $F_0$, we chose to look at the frame records of database 20 and, in particular, at the correlation between the $F_0$'s and the LSFs vectors of those records. Through statistical analysis of this information we have determined that, indeed, there are significant correlations between $F_0$ and LSFs. We have also determined that these correlations are not uniform but, rather, dissimilar even within a set of records that correspond to a given phoneme. Still further, we determined that useful correlation is found when each phoneme is considered to contain Q speech classes.

In accordance with the principles disclosed herein, therefore, the statistical dependency of $F_0$ and LSFs is modeled using a Gaussian Mixture Model (GMM), which models the probability distribution of a statistical variable z that is related to both the $F_0$ and LSFs as the sum of Q multivariate Gaussian functions, $$p(z) = \sum_{i=1}^{Q} \alpha_i N\left(z, \mu_i, \sum_i\right) \tag{1}$$

where $N(z, \mu_i, \Sigma_i)$ is a normal distribution with mean vector $\mu_i$ and covariance matrix $\Sigma_i$, $\alpha_i$ is the prior probability of class i, such that $$\sum_{i=1}^{Q} \alpha_i = 1$$

and $\alpha_i \geqq 0$, and z, for example, is $[F_0, \text{LSFs}]^T$. Specifically, employing a conventional Expectation Maximization (EM) algorithm to which the value of Q is applied, as well as the $F_0$ and LSFs vectors of all frame sub-records in database 20 that correspond to a particular phoneme type, yields the $\alpha_i$, $\mu_i$ and $\Sigma_i$, parameters for the Q classes of that phoneme type. Those parameters, which are developed prior to the synthesis process, for example by processor 51, are stored in memory 60 under control of processor 51.

With the information thus developed from the information in database 20, one can then investigate whether, for a particular phoneme label and a particular $F_0$, e.g., $F_{desired}$, the appropriate corresponding LSF vector, $LSF_{desired}$, can be estimated with the aid of the statistical information stored in memory 60.

More specifically, for a particular speech class, if $x=\{x_1, x_2, \ldots, x_N\}$ is the collection of $F_0$'s and $y=\{y_1, y_2, \ldots, y_N\}$ is the corresponding collection of LSF vectors, the question is whether a mapping $\Im$ can be found that minimizes the mean squared error $$\epsilon_{min} = E[\|y - \Im(x)\|^2] \tag{2}$$

where E denotes expectation. To model the joint density, x and y are joined to form $$z = \begin{bmatrix} x \\ y \end{bmatrix} \tag{3}$$

and the GMM parameters $\alpha_i$, $\mu_i$ and $\Sigma_i$, are estimated as described above in connection with equation (1).

Based on various considerations it was deemed advisable to select the mapping function $\Im$ to be $$\mathcal{F}(x) = E[y \mid x] = \sum_{i=1}^{Q} h_i(x) \cdot \left[\mu_i^y + \left(\sum_i^{yx}\right)\left(\sum_i^{xx}\right)^{-1} (x - \mu_i^x)\right] \text{ where} \tag{4}$$

$$h_i = \frac{\alpha_i N\left(x, \mu_i^x, \sum_j^{xx}\right)}{\sum_{j=1}^{Q} \alpha_j N\left(x, \mu_j^x, \sum_j^{xx}\right)}, \tag{5}$$

-continued $$\sum_i = \begin{bmatrix} \sum_i^{xx} & \sum_i^{xy} \\ \sum_i^{yx} & \sum_i^{yy} \end{bmatrix}, \tag{6}$$

and $$\mu_i = \begin{bmatrix} \mu_i^x \\ \mu_i^y \end{bmatrix}. \tag{7}$$

From the above, it can be seen that once the $\alpha_i$, $\mu_i$ and $\Sigma_i$, parameters are known for a given phoneme type (from the EM algorithm), equation (6) yields $$\sum_i^{xx} \quad \sum_i^{xy} \sum_i^{yx} \quad \text{and} \quad \sum_i^{yy},$$

and equation (7) yields $\mu_i^x$ and $\mu_i^y$. From this information, the parameter $h_i$ is evaluated in accordance with equation (5), allowing a practitioner to estimate the LSF vector, $LSF_{desired}$, by evaluating $\Im(x)$, for $x=F_{desired}$, in accordance with equation (4); i.e., $LSF_{desired} \cong \Im(F_{desired})$.

In the FIG. 1 system described above, one input to element 50 is the train of speech samples from element 40 that represent the concatenated speech. This concatenated speech, it may be remembered, was derived from frames of speech samples that database 20 provided. In synchronism with the frames that database 20 outputs, it also outputs the phoneme label that corresponds to the parent phoneme record ID of the frames that are being outputted, as well as the LPC vector coefficients. That is, the speech samples are outputted on line 21, while the phoneme labels and the LPC coefficients are outputted on line 22. The phoneme labels track the associated speech sample frames through elements 30 and 40, and are thus applied to element 50 together with the associated (modified) speech sample frames of the phoneme (or at least with the first frame of the phoneme). The associated LPC coefficients are also applied to element 50 together with the associated (modified) speech sample frames of the phoneme. The speech samples are applied within element 50 to filter 52, while the phoneme labels and the LPC coefficients are applied within element 50 to processor 51. Based on the phoneme label, in accord with the principles disclosed above, processor 51 obtains the $LSF_{desired}$ of that phoneme. To modify the magnitude spectrum for each voiced phoneme frame in this train of samples in accordance with the $LSF_{desired}$ of that phoneme frame, processor 51 within element 50 develops LPC coefficients that correspond to $LSF_{desired}$ in accordance with well-known techniques.

Filter 52 is a digital filter whose coefficients are set by processor 51. The output of the filter is the spectrum-modified speech signal. We chose a transfer function for filter 52 to be $$\frac{1 - \sum_{i=1}^{p} a_i z^{-i}}{1 - \sum_{i=1}^{p} b_i z^{-i}}, \tag{8}$$

where the $\alpha_i$'s are the LPC coefficients applied to element 50 from database 20 (via elements 30 and 40), and the $b_i$'s are the LPC coefficients computed within processor 51. This yields a good result because the magnitude spectrum of the signal at the input to element 50 is approximately equal to the spectrum envelope as represented the LPC vector that is stored in database 20, that is, the magnitude spectrum is equal to $$\frac{1}{1 - \sum_{i=1}^{p} a_i z^{-i}},$$

plus some small error. Of course, other transfer functions can also be employed.

Figure 2:
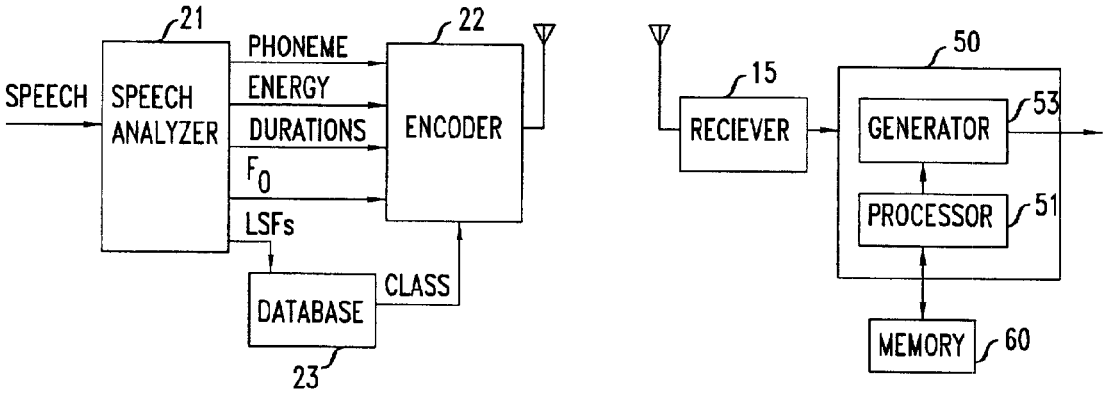

Actually, if desired, the speech samples stored in database 20 need not be employed at all in the synthesis process. That is, an arrangement can be employed where speech is coded to yield a sequence of tuples, each of which includes an $F_0$ value, duration, energy, and phoneme class. This rather small amount of information can then be communicated to a received (e.g. in a cellular environment), and the receiver synthesizes the speech. In such a receiver, elements 10, 30, and 40 degenerate into a front end receiver element 15 that applies a synthesis list of the above-described tuples to element 50. Based on the desired phoneme and phoneme class, appropriate $\alpha_i$, $\mu_i$ and $\Sigma_i$ data is retrieved from memory 60, and based on the desired $F_0$ the $LSF_{desired}$ vectors are generated as described above. From the available $LSF_{desired}$ vectors, LPC coefficients are computed, and a spectrum having the correct envelope is generated from the LPC coefficient. That spectrum is multiplied by sequences of pulses that are created based on the desired $F_0$, duration, and energy, yielding the synthesized speech. In other words, a minimal receiver embodiment that employs the principles disclosed herein comprises a memory 60 that stores the information disclosed above, a processor 51 that is responsive to an incoming sequence of list entries, and a spectrum generator element 53 that generates a train of pulses of the required repetition rate ($F_0$) with a spectrum envelope corresponding to $$\frac{1}{1 - \sum_{i=1}^{p} b_i z^{-i}}$$

where $b_i$'s are the LPC coefficients computed within processor 51. This is illustrated in FIG. 2. The minimal transmitter embodiment for communicating actual (as contrasted to synthesized) speech comprises a speech analyzer 21 that breaks up an incoming speech signal into phonemes, and frames, and for each frame it develops tuples that specify phoneme type, $F_0$, duration, energy, and LSF vectors. The information corresponding to $F_0$ and the LSF vectors is applied to database 23, which identifies the phoneme class. That information is combined with the phone type, $F_0$, duration, and energy information in encoder 22, and transmitted to the receiver.

The above-disclosed technique applies to voiced phonemes. When the phonemes are known, as in the above-disclosed example, we call this mode of operation "supervised." In the supervised mode, we have employed 27 phoneme types in database 20, and we used a value of 6 for Q. That is, in ascertaining the parameters $\alpha_i$, $\mu_i$ and $\Sigma_i$, the entire collection of frames that corresponded to a particular phoneme type was considered to be divisible into 6 classes.

At times, the phonemes are not known a priori, or the practitioner has little confidence in the ability to properly divide the recorded speech into known phoneme types. In accordance with the principles disclosed herein, that is not a dispositive failing. We call such mode of operation "unsupervised." In such mode of operation we scale up the notion of classes. That is, without knowing the phoneme to which frames belong, we assume that the entire set of frames in database 20 forms a universe that can be divided into classes, for example 32 super-classes, or 64 super-classes, where z, for example, is $[\text{LSFs}]^T$, and the EM algorithm is applied to the entire set of frames. Each frame is thus assigned to a super-class, and thereafter, each super-class is divided as described above, into Q classes, as described above.

The above discloses the principles of this invention through, inter alia, descriptions of illustrative embodiments. It should be understood, however, that various other embodiments are possible, and various modifications and improvements are possible without departing from the spirit and scope of this invention. For example, a processor 51 is described that computes the $\text{LSF}_{desired}$ based on a priori computed parameters $\alpha_i$, $\mu_i$ and $\Sigma_i$, pursuant to equations (4)–(7). One can create an embodiment, however, where the $\text{LSF}_{desired}$ vectors can also be computed beforehand, and stored in memory 60. In such an embodiment, processor 51 needs to only access the memory rather than perform significant computations.

What is claimed is:

1. A method for generating a speech signal comprising the steps of:

receiving super-class information;

receiving fundamental frequency information;

applying each tuple of super-class information and fundamental frequency information to a module that correlates fundamental frequencies with LSF vectors for different super-class to obtain a desired LSF vector associated with each of said tuples; and generating a speech spectrum, in association with each tuple, that is characterized by an LSF vector that is, or approximates, said desired LSF vector associated with each of said tuples.

2. The method of claim 1 wherein said step of generating a speech spectrum comprises the steps of generating a train of pulses with a repetition rate that corresponds to said fundamental frequency information, and filtering said train with a filter having the transfer function $$\frac{1}{1-\sum_{i=1}^{p} b_i z^{-i}},$$

where the $b_i$'s are coefficients that are derived from said desired LSF vector.

3. The method of claim 1 where sequences of tuples of super-class information and fundamental frequency are divisible into groups, where each group shares a common super-class designation.

4. The method of claim 3 where super-class designations are phoneme type designations.

5. The method of claim 1 where said module is a database.

6. The method of claim 1 further comprising a step of receiving a group of speech samples in association with each received unit of fundamental frequency information, and information representative of LPC coefficients of said group of speech samples.

7. The method of claim 6 where said step of generating a speech spectrum comprises filtering each group of speech samples to form a speech spectrum with said LPC coefficients received in said step of receiving being replaced with LPC coefficients that are related to said desired LSF vector.

8. The method of claim 6 where said step of generating a speech spectrum comprises passing each group of speech samples through a filter having the transfer function $$\frac{1-\sum_{i=1}^{p} a_i z^{-i}}{1-\sum_{i=1}^{p} b_i z^{-i}}$$

where the $\alpha_i$'s are said LPC coefficients received in said step of receiving and the $b_i$'s are LPC coefficients derived from said desired LSF vector associated with each of said tuples.

9. A method for generating a speech signal comprising the steps of:

receiving a group of speech samples for a speech frame;

receiving fundamental frequency information for said speech frame;

associating super-class information with said speech frame;

applying said super-class information and said fundamental frequency information to a module that correlates fundamental frequencies with LSF vectors for different super-classes, to obtain from said module a desired LSF vector of coefficients associated with each of said tuples; and modifying said group of speech samples to create a group of modified speech samples, such that said group of modified speech samples has a spectrum envelope whose LSF vector approximates said desired LSF vector.

10. The method of claim 9 further comprising a step of receiving a vector of coefficients that characterize said received group of speech samples.

11. The method of claim 10 where said coefficients in said received vector of coefficients are linear predictive coding coefficients.

12. The method of claim 11 where said modifying comprises applying said group of speech samples to a filter having the transfer function $$\frac{1-\sum_{i=1}^{p} a_i z^{-i}}{1-\sum_{i=1}^{p} b_i z^{-i}}$$

where the $\alpha_i$'s are said linear predictive coding coefficients and the $b_i$'s are linear predictive coding coefficients derived from said desired LSF vector.

13. A method for generating a speech signal comprising the steps of:

receiving fundamental frequency information for a speech frame;

associating super-class information with said speech frame;

applying said super-class information and said fundamental frequency information to a module that correlates fundamental frequencies with LSF vectors for different super-classes, to obtain from said module a desired LSF vector of coefficients associated with each of said tuples; and modifying said group of speech samples to create a group of modified speech samples, such that said group of modified speech samples has a spectrum envelope whose LSF vector approximates said desired LSF vector.

14. The method of claim 13 where said step of associating includes, at least for some speech frames, a step of receiving super-class information.

15. The method of claim 13 where said desired LSF is obtained in said module from a memory that maintains information about each super-class.

16. The method of claim 13 where said desired LSF is obtained in said module through computations based on parameter information stored in a memory, where said parameter information is sensitive to said super-class and to said fundamental frequency.

17. The method of claim 16 where said parameter information comprises parameters $\alpha_i$, $\mu_i$ and $\Sigma_i$, where i is an index designating one of Q different classes, $\alpha_i$ is the prior probability of class i, such that $$\sum_{i=1}^{Q} \alpha_i = 1,$$

$\mu_i$ is a mean vector for variable $z=[F_0, \text{LSFs}]^T$, and $\Sigma_i$ is a covariance matrix, and where said desired LSF vector is computed from, where $$\sum_{i=1}^{Q} h_i(x) \cdot \left[ \mu_i^y + \left( \sum_i^{yx} \right) \left( \sum_i^{xx} \right)^{-1} (x - \mu_i^x) \right]$$

where $$h_i = \frac{\alpha_i N\left(x, \mu_i^x, \sum_i^{xx}\right)}{\sum_{j=1}^{Q} \alpha_j N\left(x, \mu_j^x, \sum_j^{xx}\right)},$$

$$\sum_i = \begin{bmatrix} \sum_i^{xx} & \sum_i^{xy} \\ \sum_i^{yx} & \sum_i^{yy} \end{bmatrix},$$

-continued and $$\mu_i = \begin{bmatrix} \mu_i^x \\ \mu_i^y \end{bmatrix}.$$

18. A method for communicating information from a transmitter to a receiver comprising the steps of, in the transmitter:

receiving a speech signal;

subdividing said speech signal into a plurality of speech frames;

analyzing each frame of said speech frames identify at least fundamental frequency of speech in said frame, and energy in said frame; and transmitting said information that specifies said fundamental frequency and said energy, at least for some of said speech frames, those being selected speech frames, transmitting information about super-class identities of the phoneme-related segments from which said selected speech frames are subdivided receiving said fundamental frequency information transmitted by said step of transmitting for each speech frame;

receiving said super-class identities;

associating received super-class information with received fundamental frequency information;

applying said fundamental frequency information and associated super-class information and to a module that correlates fundamental frequencies with LSF vector for different super-classes, to obtain from said module a desired LSF vector of coefficients associated with each of said tuples; and creating a speech frame with a spectrum envelope that is related to said desired LSF vector speech samples, such that said group of modified speech samples has a spectrum envelope whose LSF vector approximates said desired LSF vector.

* * * * *